United States Patent [19]

Masiello

[11] 4,129,266

[45] Dec. 12, 1978

[54] PAPER CASSETTE

[75] Inventor: Felix R. Masiello, Parsippany, N.J.

[73] Assignee: Addressograph-Multigraph Corporation, Los Angeles, Calif.

[21] Appl. No.: 817,891

[22] Filed: Jul. 21, 1977

[51] Int. Cl.[2] ..... B65H 17/02

[52] U.S. Cl. ..... 242/68.4; 242/68.5

[58] Field of Search ..... 242/55, 68, 68.4, 68.5, 242/129.51, 129.53, ; 355/3, 3 DR; 197/133 R

[56] References Cited

U.S. PATENT DOCUMENTS

| | | | |
|---|---|---|---|
| 2,299,626 | 10/1942 | Hunt | 242/68.5 |
| 3,730,452 | 5/1973 | Schwartz | 242/68.4 |
| 4,014,426 | 3/1977 | Neufeld | 242/68.4 |

*Primary Examiner*—Edward J. McCarthy
*Attorney, Agent, or Firm*—Ray S. Pyle; Robert S. Hulse

[57] ABSTRACT

The drawings illustrate a cassette only, to fit into any machine that uses a paper roll supply and requires accurate alignment of that roll supply with the processing machine. The cassette is bodily urged against one wall of the host machine in order to establish that wall as a reference. In the housing is a roll support core which is compound in that it has two members which are telescoped and spring-urged to expand. This will gauge the core against the wall of the housing that's engaged with the wall of the host machine. Then, the spring-urged slidable component of the core carries a positionable slide plate which, if the roll were not inserted, would come to rest at a position short of the roll length, and therefore constantly urges the roll against the cassette wall as a gauge of the roll by mesne gauge means with the host machine.

1 Claim, 4 Drawing Figures

PAPER CASSETTE

BACKGROUND OF THE INVENTION

Copy machines, photocomposition machines, and similar machines using rolls of supply paper are adversely affected if paper supply is permitted to drift laterally. Marginal lines are very adversely affected by lateral drifting.

It may be possible to make ultra close tolerance support devices but such careful manufacturing is very expensive. Hence, it has been prior practice to do a reasonably careful job of cassette supply manufacturing, and to accept the lack of good tolerance when it occurs.

SUMMARY OF THE INVENTION

This invention is directed to a supply cassette which has its primary purpose in the establishment of paper within the cassette through a gauge surface, and to establish the cassette to a gauge surface of the host machine, thereby establishing the roll by mesne gauge surfaces with the host machine.

FIGURES OF THE DRAWING

The illustrated embodiment of the invention has been designed with use in a photocomposition machine, but its use is equally applicable to any machine requiring precise positioning of a paper supply roll. The cassette is loaded externally at the host machine, and then put into position for service.

The cassette housing is indicated by the reference number 10 and employs parallel end walls 12 and 13 which are the primary means of alignment and support, the balance of the housing including a cap 14 being for light-tight enclosure.

Figure 1:
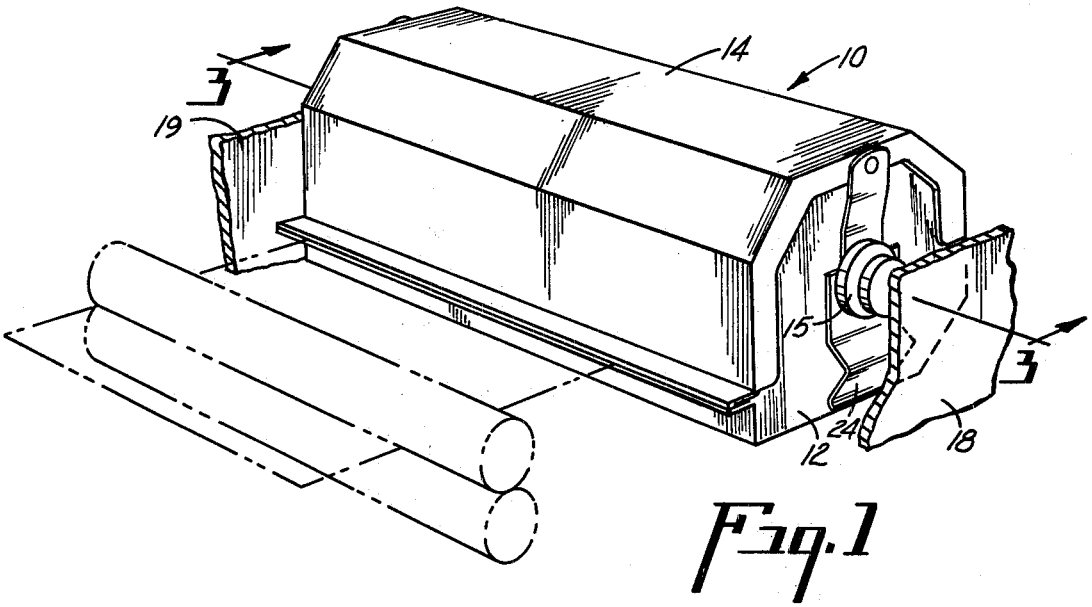
FIG. 1 is a perspective view of a cassette with a fragment of host machine support walls, and a symbolic set of drive rollers of the host machine.
Figure 2:
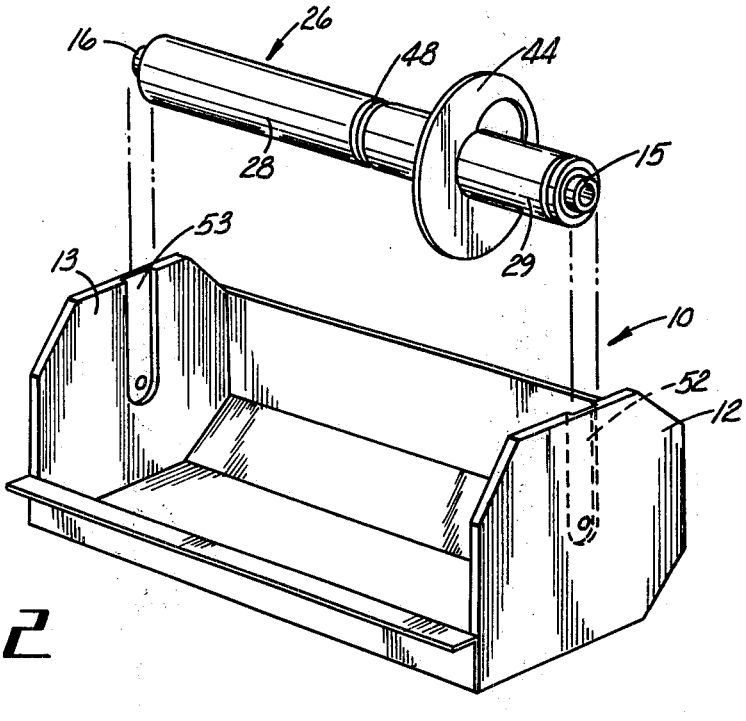
FIG. 2 is a perspective exploded view of only the cassette walls and core without the supporting lid and external hub assembly.

Externally of the housing, (not shown in FIG. 2) are axially aligned hubs 15 and 16 which constitute hub means extending from the end walls for mounting the housing between support walls of the host process machine. The hubs establish an axis for a supported roll of processed paper indicated by the phantom outline 17.

The host machine, referred to as the process machine, has support walls 18 and 19 shown only as fragments in this drawing, because the host machine constitutes no part of the present invention.

The host machine walls 18 and 19 have downwardly directed grooves 20 and 21 which accept and guide the housing hub means to a service position between the support walls.

A flat spring 24 carried by the housing end wall 12, reacts between the host machine wall 18 and the cassette wall 12 to urge the housing into a gauging relationship with the opposite support wall 19.

The roll 17 is supported on a central core 26 which is preferably cylindrical in overall configuration, although noncircular cross sections can be employed if so desired.

The preferred embodiment of the central core has a first section 28 and a second section 29. The first section is further described as having a first portion 30 and a second portion 31. The first portion begins at one end of the central core 26 and has an external surface dimensioned to support a supply roll, but is shorter than the minimum width roll to be supported.

The second portion 31 of the first section 28 is smaller in section configuration and extends to a plunger hub end piece 32. Hub end piece 32 is mounted by a bolt 34 with a covering sleeve 35 which serves as a bearing support and permits the end piece to reciprocate along the central axis of the core. A Belleville washer 36 serves as yieldable means to urge the plunger hub 32 to its extended position. When free of restraint of the end walls 12 and 13, the length of the first core section 28 is greater than the distance between the end walls and thereby requiring compression of the Belleville washer 36 in order to reside within the confines of the end walls 12 and 13.

The second section 29 is essentially a reciprocable sleeve mounted over the second portion 31 of first section 28. The second section has a through bore 38 fitted with bearings 49 to enable the section 29 to reciprocate on the surface of portion 31.

A spring 42 confined by a washer 43 and the Belleville 36, presses against bearing 49 and thereby transmits a yieldable drive force to the section 29 in the direction of end wall 13.

The resilient drive of section 29 is employed to drive a confined roll 17 also toward the wall 13. To accomplish such drive, a shield 44 is captured on the external surface of the section 29 and serves as a confining wall cooperating with the wall 13.

Figure 3:
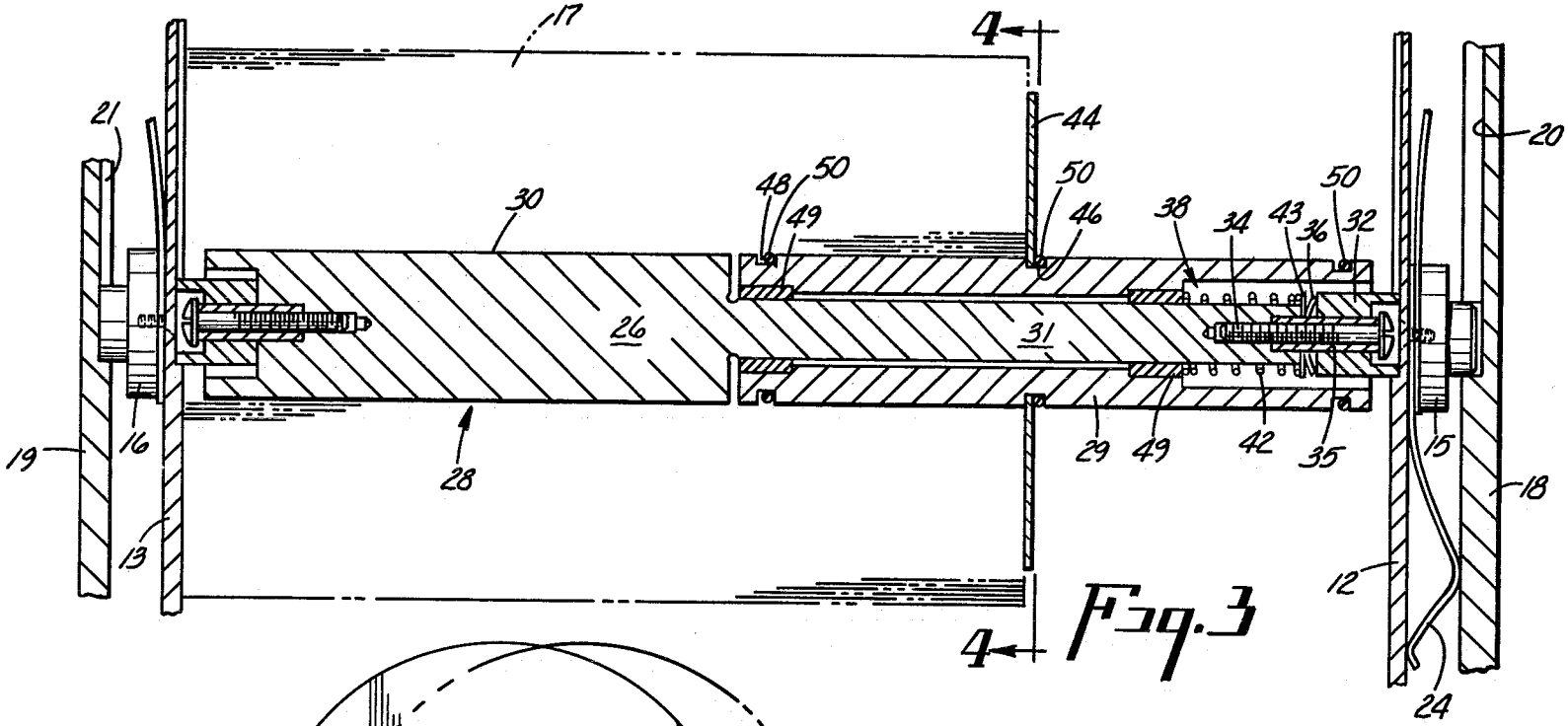
FIG. 3 is a sectional view through the cassette and the fragment of the host machine support walls.
Figure 4:
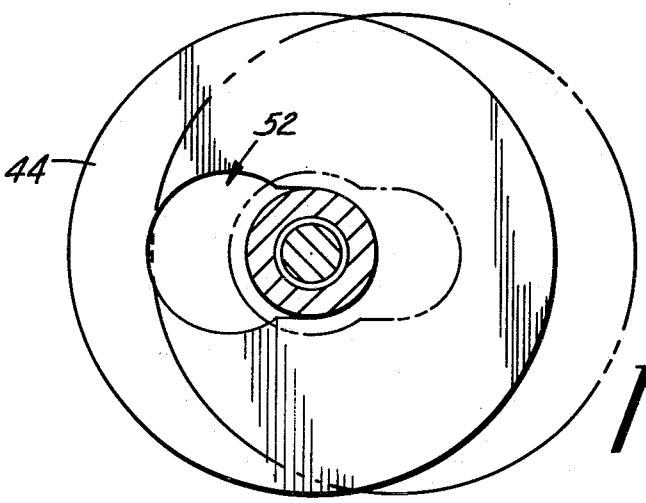
FIG. 4 is a view taken along 4-4 of FIG. 3.

Because more than one size paper roll is generally acceptable by a particular host processing machine, it is desirable to have the shield 44 positionable in a plurality of possible longitudinal positions corresponding to the dimension of a supply roll to be serviced. The FIG. 3 illustrates two positions illustrated by grooves 46 and 48, each supplied with an O-ring 50. The shield 44, as seen in FIG. 4, has a keyhole slot opening 52, the smaller portion of which fits snuggly to the diameter of the groove, and the larger portion enabling free movement along the shaft. The O-ring in each of the grooves is provided to fill between the surface of the shield and the groove to frictionally clamp the shield into operative position.

The central core 26 is removably fitted to the cassette end walls 12 and 13 by guide slots 52 and 53.

What is claimed is:

1. A supply cassette for precise alignment of a paper roll supply in a process machine; comprising:
   - a housing defined by walls including parallel end walls having external, axially aligned, hub means extending from said end walls for mounting the housing between support walls of the process machine, said hub means establishing an axis for the supported roll, and yieldable means positionable between one housing end wall and one support wall for urging the housing into a gauging relationship with the opposite support wall;
   - a central core axially aligned with said hub means for support of a supply roll;
   - the core having a first and second section:
     - said first core section having two portions, the first beginning at one end of the core and having an external surface dimensioned to support a supply roll, said first portion being of a length shorter than the minimum width roll to be supported, and the second portion being smaller in section configuration and extending to a plunger hub end piece, said hub end piece mounted by guide means to reciprocate along said axis, and a yieldable means urging the end piece to its extended limit, the length of said first core section being greater than the distance between said end walls when fully extended and shorter when fully retracted;

said second section being tubular and carried coaxially with said second portion of the first section in slidable relationship therewith;

yieldable means urging said second section toward the first portion of said first section of said core;

a shield for establishing a retaining space between one housing wall and the shield to confine a supply roll, and means for securing said shield to the second section in any one of a plurality of possible longitudinal positions corresponding to s supply roll to be serviced;

whereby, said housing and the supply roll therein are gauged from one side of the machine being serviced.

* * * * *